US005934921A

United States Patent [19]

Doong

[11] Patent Number: 5,934,921

[45] Date of Patent: Aug. 10, 1999

[54] POWER SUPPLY AND THE JOINT STRUCTURE OF ADAPTOR PLUG THEREOF

[75] Inventor: Jung-Chaun Doong, Taipei, Taiwan

[73] Assignee: Rotrans Electrical Corp., Ltd., Taiwan

[21] Appl. No.: 09/104,056

[22] Filed: Jun. 24, 1998

[51] Int. Cl.[6] ..... H01R 29/00

[52] U.S. Cl. ..... 439/172

[58] Field of Search ..... 363/146, 147; 439/43, 115, 172, 170, 956

[56] References Cited

U.S. PATENT DOCUMENTS 5,159,545 10/1992 Lee ..... 363/146

*Primary Examiner*—Shawn Riley

*Attorney, Agent, or Firm*—Pro-Techtor International Services

[57] ABSTRACT

A power supply and an adaptor plug therefor, wherein a slot with a guide rail is provided at the bottom at one end of the power supply. Two body spring leaves connected to a circuit board of the power supply extend through and protrude from two body spring leaf holes in the power supply. The adaptor plug is provided with a guide groove. Two insertion leg spring leaves on the two insertion legs of the adaptor plug extend through and protrude from two insertion leg spring leaf holes on the adaptor plug. The adaptor plug is installed in the slot of the power supply by a joint formed by the guide groove and the guide rail. The insertion leg spring leaves and the body spring leaves contact each other.

4 Claims, 3 Drawing Sheets

POWER SUPPLY AND THE JOINT STRUCTURE OF ADAPTOR PLUG THEREOF

FIELD OF THE INVENTION

The present invention is related to a power supply and the joint structure of an adaptor plug thereof. The joint is simple, convenient and stable. The power supply is applicable to the plug specifications in various different regions in line with different adaptor plugs.

DESCRIPTION OF THE PRIOR ART

So far as electric products are concerned, various regions and/or countries in the world have their own different safety norms and specifications. For instance, in the aspect of electric plugs, the insertion holes of power sockets used in U.S.A., Germany, Australia and English are parallel flat holes, parallel round holes, oblique flat holes and parallel slots with ground holes respectively. Therefore the insertion legs of the plugs of their electric products have to be parallel flat insertion legs (as shown in FIG. 3), parallel round insertion legs (as shown in FIG. 5), oblique flat insertion legs (as shown in FIG. 6) and parallel pillar-shaped insertion legs with ground insertion legs (as shown in FIG. 7) respectively so as to be applicable to the specific regions and/or countries.

However, the sales and use of an electric product are frequently not limited to a single region but sometimes it is sold or circulated in different regions or countries. So far as the different electric plug specifications prescribed in different regions or countries are concerned, their manufacturers have to prepare the electric products with different plug specifications. As a result, they have increased costs for molds, and the electric products themselves with the established plug specifications cannot be sold in other regions or countries where the plug specifications are different. For example, when a certain electric product with the American plug specification is sold out but there is a demand for it, it cannot be replaced with the same electric product with a plug of other specifications. An electric product with a plug of the American specifications has to be made. Since the interchangeability of electric products is insufficient, their manufacturers have to make and store the electric products with different plug specifications and therefore their manufacturing cost is increased, and the efficiency of their production and sales is lowered.

In view of the above, electric products in general are the subject matter of the present invention, namely, a power supply with an adaptor plug is provided. The plug is separately made to be joined with the power supply for use. Making use of multiple adaptor plugs with various specifications can adapt the same power supply to the plugs with different specifications in various regions and countries.

FIGS. 1 and 2 are side and bottom breakdown views of a conventional power supply and the adaptor plug thereof respectively. One end of the power supply 1' is provided with an inward grooved space 11' and a joint 12' to connect a circuit board 13' of power supply 1'. A seat 21' of an adaptor plug 2' is inserted into the grooved space 11' to connect the joint 12' electrically with a spring leaf. An insertion board 22' of adaptor plug 2' is inserted in the seat 21' to connect a spring leaf 222' of an insertion leg 221' of the insertion board 22' and a spring leaf hole 211 ' of the seat 21' electrically. Choosing an insertion leg 221' with different models and specifications of the insertion board 22' makes the power supply 1' applicable to plugs with different specifications required in various regions and countries.

However, the foregoing conventional power supply and adaptor plugs thereof have a complicated structure which is troublesome and inconvenient to manufacture.

SUMMARY OF THE INVENTION

The present invention is a power supply structure and a joint structure for adaptor plugs. A slot is provided at the bottom of one end of the power supply with a guide rail and two body spring leaf holes therein. Each of the two body spring leaves is connected to the circuit board of the power supply and extend through and protrudes from each of the two body spring leaf holes. An adaptor plug is provided with a guide groove and two insertion leg spring leaf holes. Two insertion spring leaves on the insertion leg of the plug extend through and protrude from the two insertion leg spring leaf holes. The adaptor plug is installed in the slot of the power supply through the joint formed by the guide groove and the guide rail. The insertion leg spring leaves of the adaptor plug and the body spring leaves of the power supply contact each other so as to achieve an electrical connection. dr

DETAILED DESCRIPTION OF THE PREFERRED EMBODIMENTS

Figure 1:
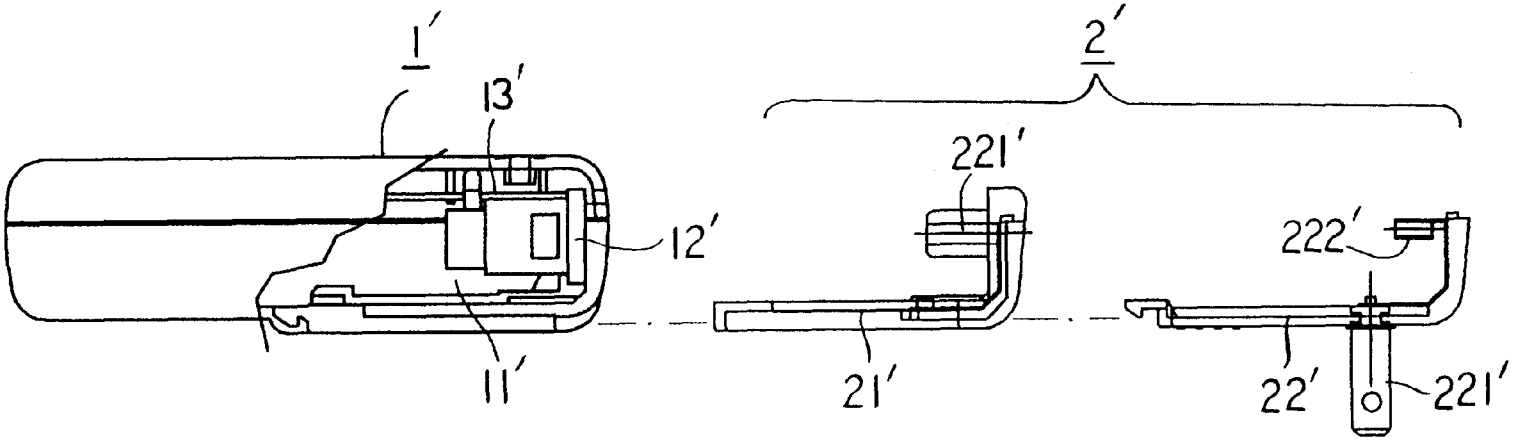
FIG.1(Prior Art)
FIG. 1 is a side breakdown view of a conventional power supply and the adaptor plug thereof.
Figure 2:
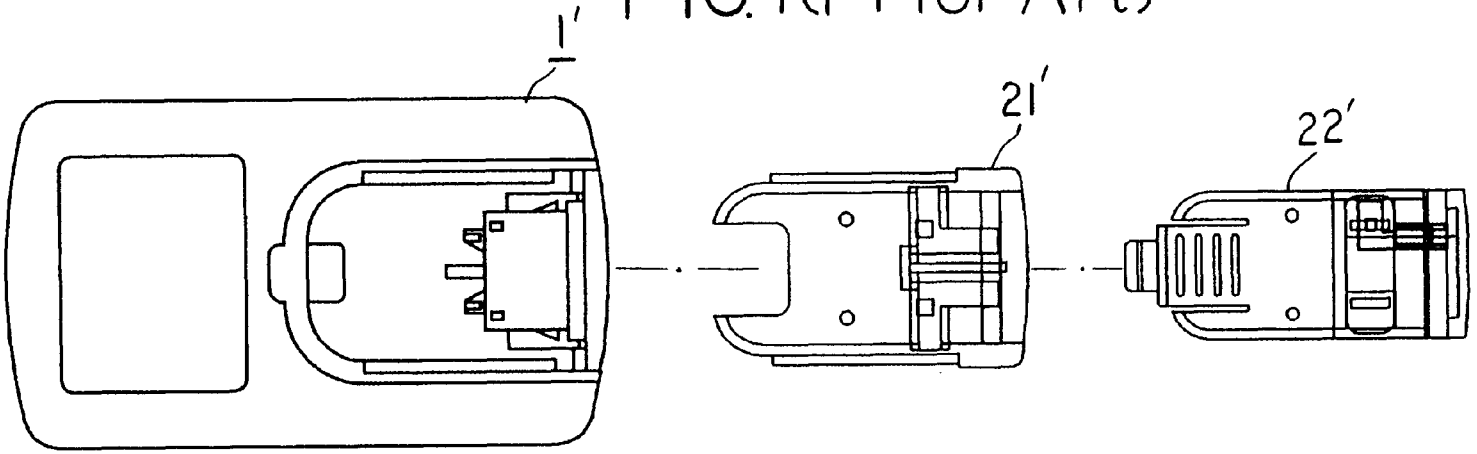
FIG.2(Prior Art)
FIG. 2 is a bottom breakdown view of a conventional power supply and the adaptor plug thereof.
Figure 3:
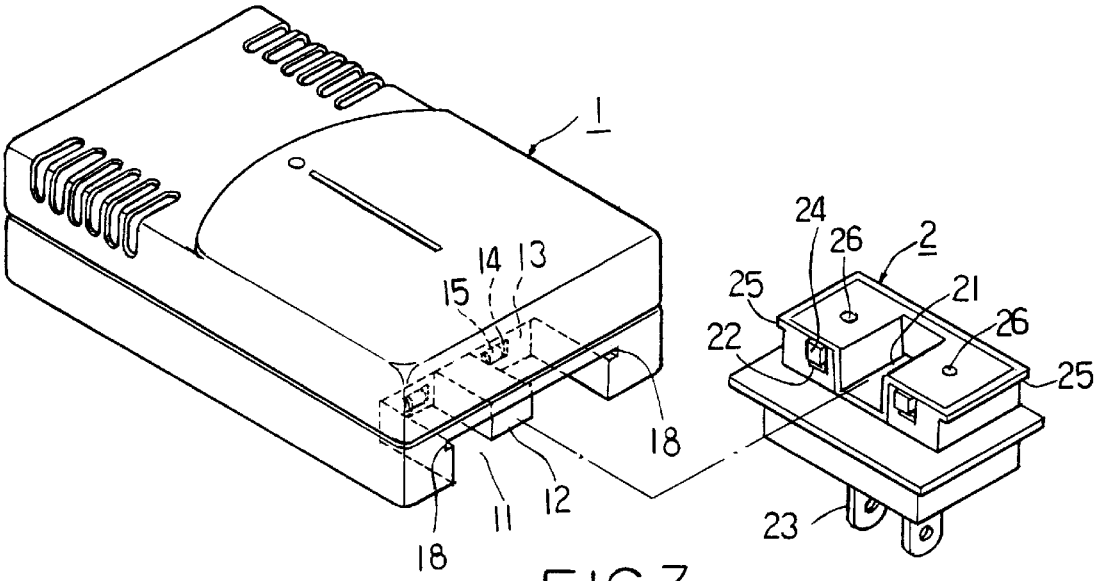
FIG. 3 is a breakdown view of a power supply and the adaptor plug thereof according to the present invention.
Figure 4:
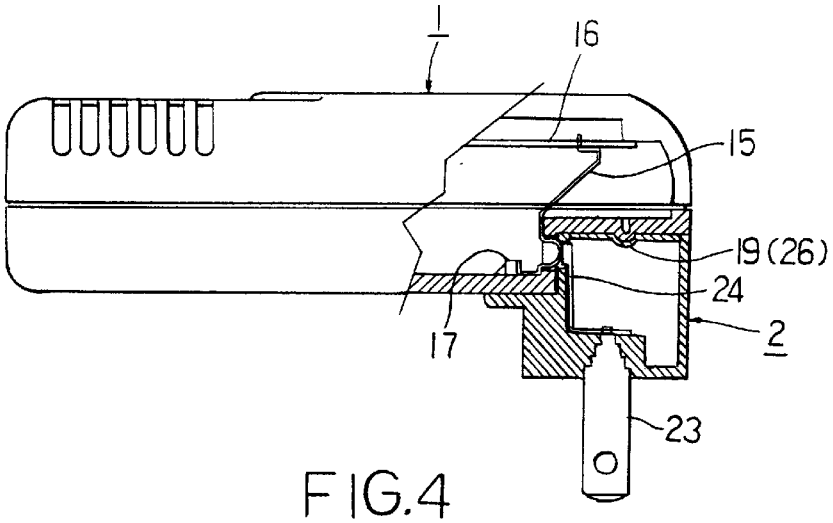
FIG. 4 is an assembly section view of a power supply and the adaptor plug thereof according to the present invent ion.

FIGS. 3 and 4 show a breakdown view and an assembly section view of one example according to the present invention. The device comprises a power supply 1 and an adaptor plug 2. A slot 11 is provided at the bottom at one end of the power supply 1. A longitudinal guide rail 12 is provided in the approximately central position of the slot 11. The inner wall 13 of slot 11 is provided with two body spring leaf holes 14 and two body spring leaves 15. The ends of these two body spring leaves 15 are connected to a circuit board 16 of the power supply 1, and extend through and protrude from the two body spring leaf holes 14. Other ends of these two body spring leaves 15 contact a retaining wall 17 provided in the power supply 1.

A guide groove 21 is provided at the top of adaptor plug 2 and corresponds to the guide rail 12 of power supply 1. Two insertion leg spring leaf holes 22 are provided on the front end surface of adaptor plug 2 and correspond to the two body spring leaf holes 14 of power supply 1. Two downward insertion legs 23 are provided at the bottom surface of adaptor plug 2, and two insertion leg spring leaves 24 are connected to these two insertion legs 23 and extend through and protrude from the foregoing two insertion leg spring leaf holes 22.

When joining and using the adaptor plug 2 and the power supply 1, the guide groove 21 and the guide rail 12 join each other. The adaptor plug 2 is installed in the slot 11 of power supply 1 and pushed to the right place therein to finish the mechanical joint. At the same time, the insertion leg spring leaves 22 and the body spring leaves 15 contact each other to finish the electrical connection. The power supply 1 can be ready for use through inserting the adaptor plug 2 into a corresponding socket (not shown in the drawing).

In addition to the joint of the guide rail 12 and the guide groove 21 between the power supply 1 and the adaptor plug 2, a groove 18 is provided on each of two sides of the slot 11 of the power supply 1 to receive two protruding wings 25 in corresponding positions on the adaptor plug 2 so as to increase the joint stability between the power supply 1 and the adaptor plug 2.

In order to increase the firmness of the joint between the power supply 1 and the adaptor plug 2, a catch lug 19 (or catch recess) is provided on an inner wall such as the top inner wall of the slot 11 of power supply 1. A catch recess 26 (or catch lug) is provided on a corresponding outer wall such as the top surface of adaptor plug 2 so that both catch lug 19 and catch recess 26 can mate with each other when the joint is formed.

Figure 5:
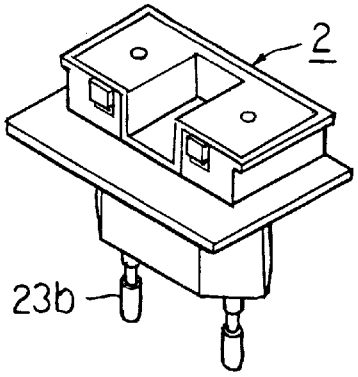
FIG. 5 is an elevation view of another example of the adaptor plug according to the present invention.
Figure 6:
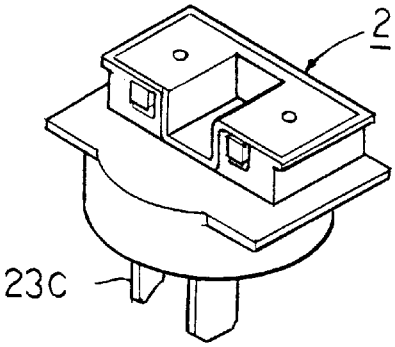
FIG. 6 is an elevation view of still another example of the adaptor plug according to the present invention.
Figure 7:
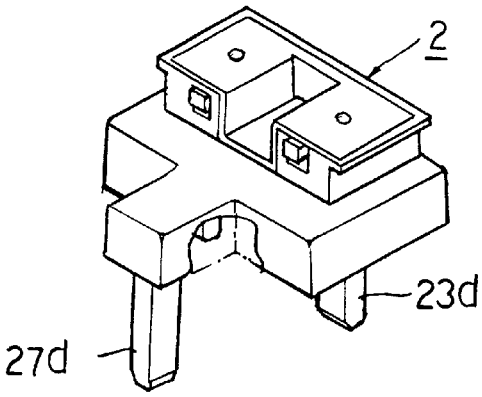
FIG. 7 is an elevation view of still further another example of the adaptor plug according to the present invention.

The insertion leg 23 of adaptor plug 2 as shown in FIG. 3 is a parallel flat insertion leg according to the American specifications. The leg may also be a parallel round insertion leg 23*b* according to the German specifications (as shown in FIG. 5), an oblique flat insertion leg 23*c* according to the Australian Specification (as shown in FIG. 6), or a parallel pillar-shaped insertion leg 23*d* with a ground insertion leg 27*d* according to the English specifications (as shown in FIG. 7). Choosing an appropriate adaptor plug 2 with an insertion leg from various specifications to connect to the power supply 1 can make the power supply 1 applicable to the country or region as required.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A power supply and an adaptor plug therefor, comprising:

a power supply with a slot therein, a longitudinal guide rail is provided in said slot, two body spring leaf holes and two body spring leaves are provided on an inner wall of said slot, one end of each of said body spring leaves is connected to a circuit board of said power supply, said spring leaves extend through and protrude from said two body spring leaf holes in said power supply, and another end of each of said spring leaves contacts a retaining wall provided in said power supply; and an adaptor plug with a guide groove corresponding to said guide rail of said power supply, a surface of said adaptor plug is provided with two insertion leg spring leaf holes corresponding to said body spring leaf holes of said power supply, and said adaptor plug is provided with two downward insertion legs, and two insertion leg spring leaves are connected to said insertion legs and extend through and protrude from said insertion leg spring leaf holes; and to join said adaptor plug and said power supply for use, said guide rail and said guide groove mate with each other, said adaptor plug is installed in said slot of said power supply and said insertion leg spring leaves and said body spring leaves contact each other so as to form an electrical connection, such that said power supply is ready for use.

2. The power supply and adaptor plug as claimed in claim 1, wherein:

each of two sides of said slot of said power supply is provided with a groove, and each of two sides of said adaptor plug is provided with a protruding wing in a position corresponding to that of said groove on each of said two sides of said slot of said power supply.

3. The power supply and adaptor plug as claimed in claim 1, wherein:

a securing lug is provided on either said guide rail or said guide groove, and a securing recess is provided on either said guide groove or said guide rail to mate with said securing lug when said power supply is connected to said adaptor plug, thereby increasing security of a connection between said power supply and said adaptor plug.

4. The power supply and adaptor plug as claimed in claim 2, wherein:

a securing lug is provided on either said guide rail or said guide groove, and a securing recess is provided on either said guide groove or said guide rail to mate with said securing lug when said power supply is connected to said adaptor plug, thereby increasing security of a connection between said power supply and said adaptor plug.

* * * * *